US011975933B2

(12) United States Patent
Ando

(10) Patent No.: US 11,975,933 B2
(45) Date of Patent: May 7, 2024

(54) SHEET FEEDING CASSETTE AND IMAGE FORMING APPARATUS

(71) Applicant: KYOCERA Document Solutions Inc., Osaka (JP)

(72) Inventor: Satoshi Ando, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 232 days.

(21) Appl. No.: 17/580,963

(22) Filed: Jan. 21, 2022

(65) Prior Publication Data

US 2022/0234846 A1 Jul. 28, 2022

(30) Foreign Application Priority Data

Jan. 26, 2021 (JP) ..... 2021-010333

(51) Int. Cl.
*B65H 1/14* (2006.01)
*B65H 1/04* (2006.01)
*B65H 1/26* (2006.01)

(52) U.S. Cl.
CPC ..... *B65H 1/14* (2013.01); *B65H 1/04* (2013.01); *B65H 1/26* (2013.01); *B65H 1/266* (2013.01); *B65H 2405/1112* (2013.01); *B65H 2405/1116* (2013.01); *B65H 2405/114* (2013.01); *B65H 2511/12* (2013.01); *B65H 2801/06* (2013.01)

(58) Field of Classification Search
CPC ... B65H 1/04; B65H 1/08; B65H 1/14; B65H 1/26; B65H 2405/111; B65H 2405/1112; B65H 2405/1116; B65H 2405/11162; B65H 2405/114; B65H 2511/12
See application file for complete search history.

(56) References Cited

U.S. PATENT DOCUMENTS

2009/0189329 A1* 7/2009 Kaseda ..... B65H 1/12 271/4.1
2010/0025923 A1* 2/2010 Hamasaki ..... B65H 1/266 271/171
2020/0062519 A1* 2/2020 Noguchi ..... B65H 1/08
2023/0234802 A1* 7/2023 Kohara ..... B65H 31/20 270/1.01

FOREIGN PATENT DOCUMENTS

JP 2020-007105 A 1/2020

* cited by examiner

*Primary Examiner* — Prasad V Gokhale
(74) *Attorney, Agent, or Firm* — Studebaker & Brackett PC

(57) ABSTRACT

A sheet feeding cassette includes a main body, a lift plate, a pair of side cursors, and an auxiliary lift plate. The main body is configured to accommodate a sheet fed out in a predetermined sheet feeding direction. The lift plate is provided in the main body in a liftable manner, and has a sheet placement surface on which the sheet is placed. The pair of side cursors is configured to be moved in a width direction perpendicular to the sheet feeding direction and to come into contact with side edges of the sheet placed on the lift plate to align the sheet. The auxiliary lift plate is detachably attached to a notch portion which is formed in the lift plate so as to allow a moving of the side cursors.

7 Claims, 9 Drawing Sheets

SHEET FEEDING CASSETTE AND IMAGE FORMING APPARATUS

INCORPORATION BY REFERENCE

This application is based on and claims the benefit of priority from Japanese patent application No. 2021-010333 filed on Jan. 26, 2021, which is incorporated by reference in its entirety.

BACKGROUND

The present disclosure relates to a sheet feeding cassette which stores a sheet on which an image is to be formed and an image forming apparatus.

In an image forming apparatus such as a multifunctional peripheral and a printer, a sheet is fed from a sheet feeding cassette to an image forming part in a predetermined sheet feeding direction. The sheet feeding cassette includes a liftable and lowerable lift plate on which the sheet is placed and a pair of side cursors which aligns the placed sheets in a width direction perpendicular to the sheet feeding direction.

The pair of side cursors are moved in the width direction to align the sheets. Therefore, the lift plate has notches through which the side cursors are passed. In some cases, the notch may be formed at one or more places of the lift plate. In other words, the lift plate may be formed into a branched shape.

In the above-described sheet feeding cassette, in order to align the small-sized sheets, the pair of side cursors is disposed on the downstream side in the sheet feeding direction (a side closer to a sheet feeding device). That is, the notch is disposed on the downstream side in the sheet feeding direction. If the notch is disposed in the above-described manner, the sheets may not be placed on the lift plate stably.

For example, in a case where a large number of large-sized sheets are placed (for example, 4000 sheets), the downstream side portions of the sheets in the sheet feeding direction overlap with the notch. In this case, the downstream side portions of the sheets may be deformed without being supported by the lift plate, and the sheet may not be fed stably. On the other hand, the side cursors may be provided with a notch through which the branched shape lift plate is passed. However, in this case, when the number of the sheets is large, the size of the notch becomes large, and it becomes difficult to secure the strength of the side cursor.

SUMMARY

In accordance with an aspect of the present disclosure, a sheet feeding cassette includes a main body, a lift plate, a pair of side cursors, and an auxiliary lift plate. The main body is configured to accommodate a sheet fed out in a predetermined sheet feeding direction. The lift plate is provided in the main body in a liftable manner, and has a sheet placement surface on which the sheet is placed. The pair of side cursors is configured to be moved in a width direction perpendicular to the sheet feeding direction and to come into contact with side edges of the sheet placed on the lift plate to align the sheet. The auxiliary lift plate is detachably attached to a notch portion which is formed in the lift plate so as to allow a moving of the side cursors.

In accordance with an aspect of the present disclosure, an image forming apparatus includes the sheet feeding cassette; an apparatus main body to which the sheet feeding cassette is detachably attached; a sheet feeding device which feeds the sheet from the sheet feeding cassette attached to the apparatus main body; and an image forming part which forms an image on the sheet fed from the sheet feeding cassette by the sheet feeding device.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, an image forming apparatus and a large capacity deck according to one embodiment in the present disclosure will be described.

Figure 1:
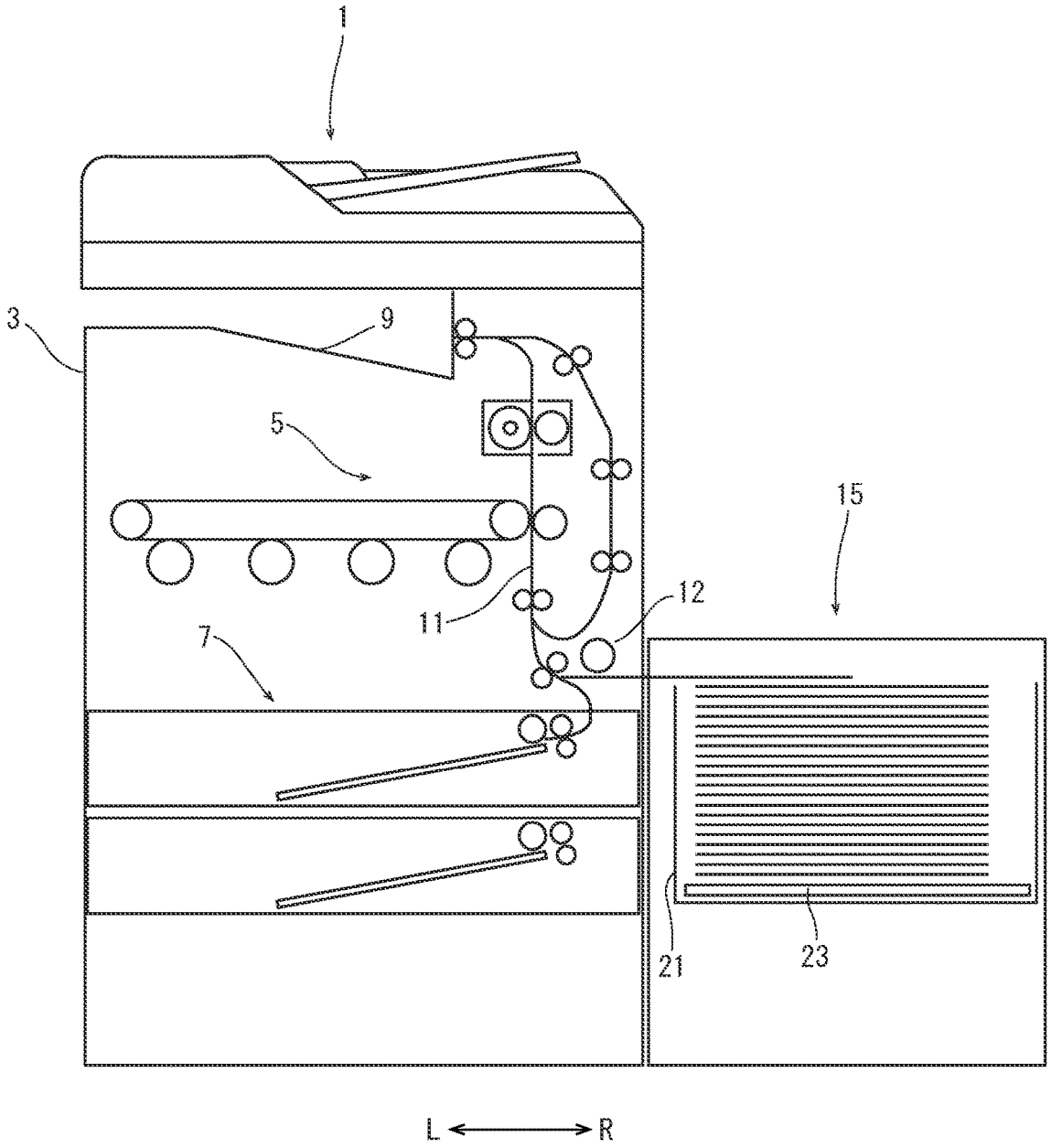
FIG. 1 is a front view schematically showing inner structures of an image forming apparatus and a large capacity deck according to one embodiment of the present disclosure.

First, with reference to FIG. 1, an entire structure of the image forming apparatus 1 will be described. FIG. 1 is a front view schematically showing an inner structure of the image forming apparatus 1. In the following description, a front side of the paper plane on which FIG. 1 is drawn is defined as a front side of the image forming apparatus 1. Fr, Rr, L, R, Up and Lo marked in each drawing indicate the front side, the rear side, the left side, the right side, the upper side and the lower side of the image forming apparatus 1, respectively.

The apparatus main body 3 of the image forming apparatus 1 includes a sheet feeding part 5, an electrophotographic type image forming part 7, and a discharge tray 9. Further, the apparatus main body 3 is formed with a conveyance path 11 along which the sheet is conveyed upward from the sheet feeding part 5 to the discharge tray 9 through the image forming part 7.

A large capacity deck 15 is connected to the image forming apparatus 1. The large capacity deck 15 can store a large number of sheets (for example, 4000 sheets). When the large capacity deck 15 is connected to the image forming apparatus 1, the sheet can be fed to the conveyance path 11 of the image forming apparatus 1. The large capacity deck 15 is an example of a sheet feeding cassette of the present disclosure.

Figure 2:
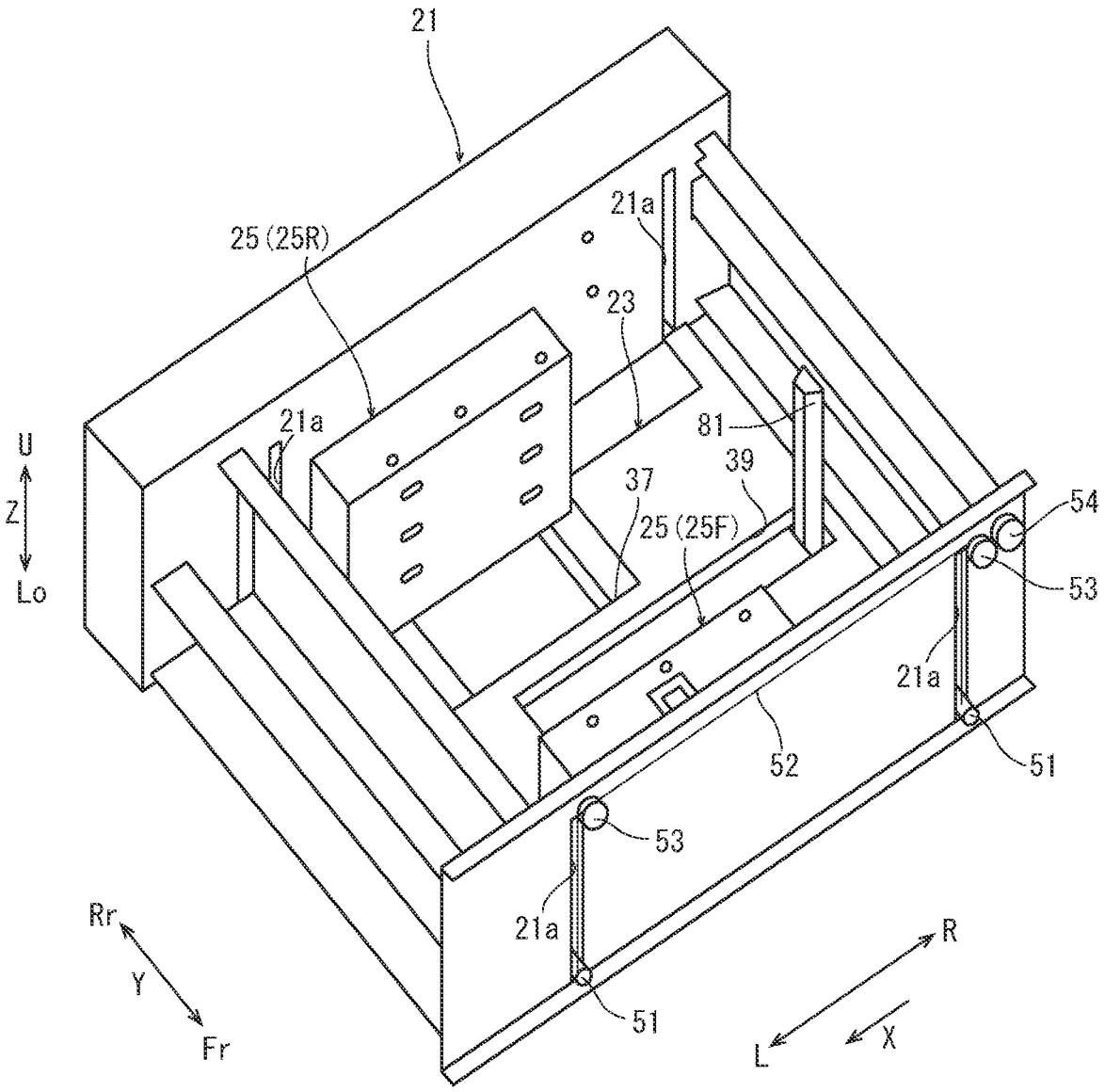
FIG. 2 is a perspective view schematically showing the large capacity deck according to the embodiment of the present disclosure.
Figure 3:
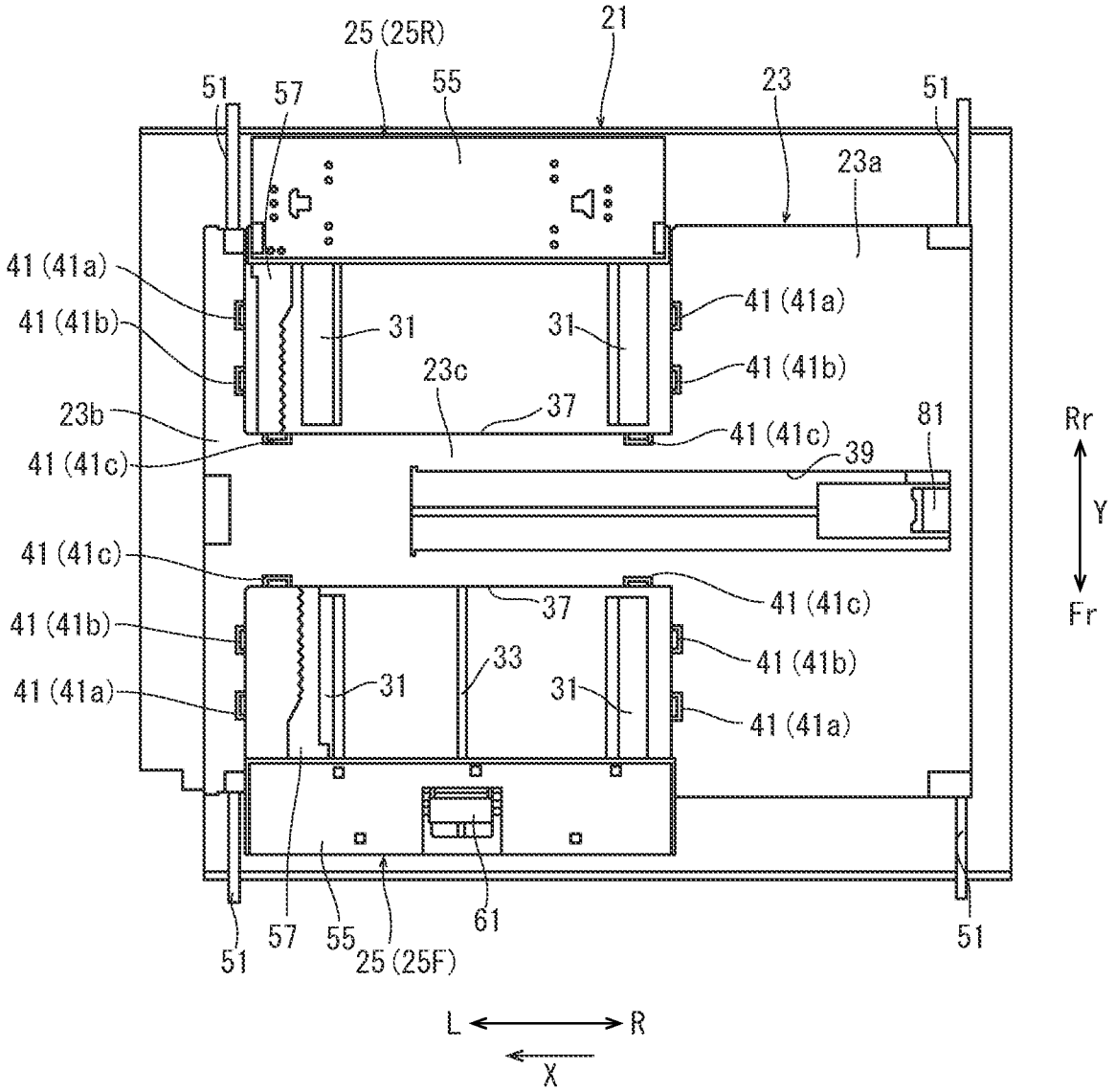
FIG. 3 is a plan view showing the large capacity deck (in a state where an auxiliary lift plate is detached) according to the embodiment of the present disclosure.
Figure 4:
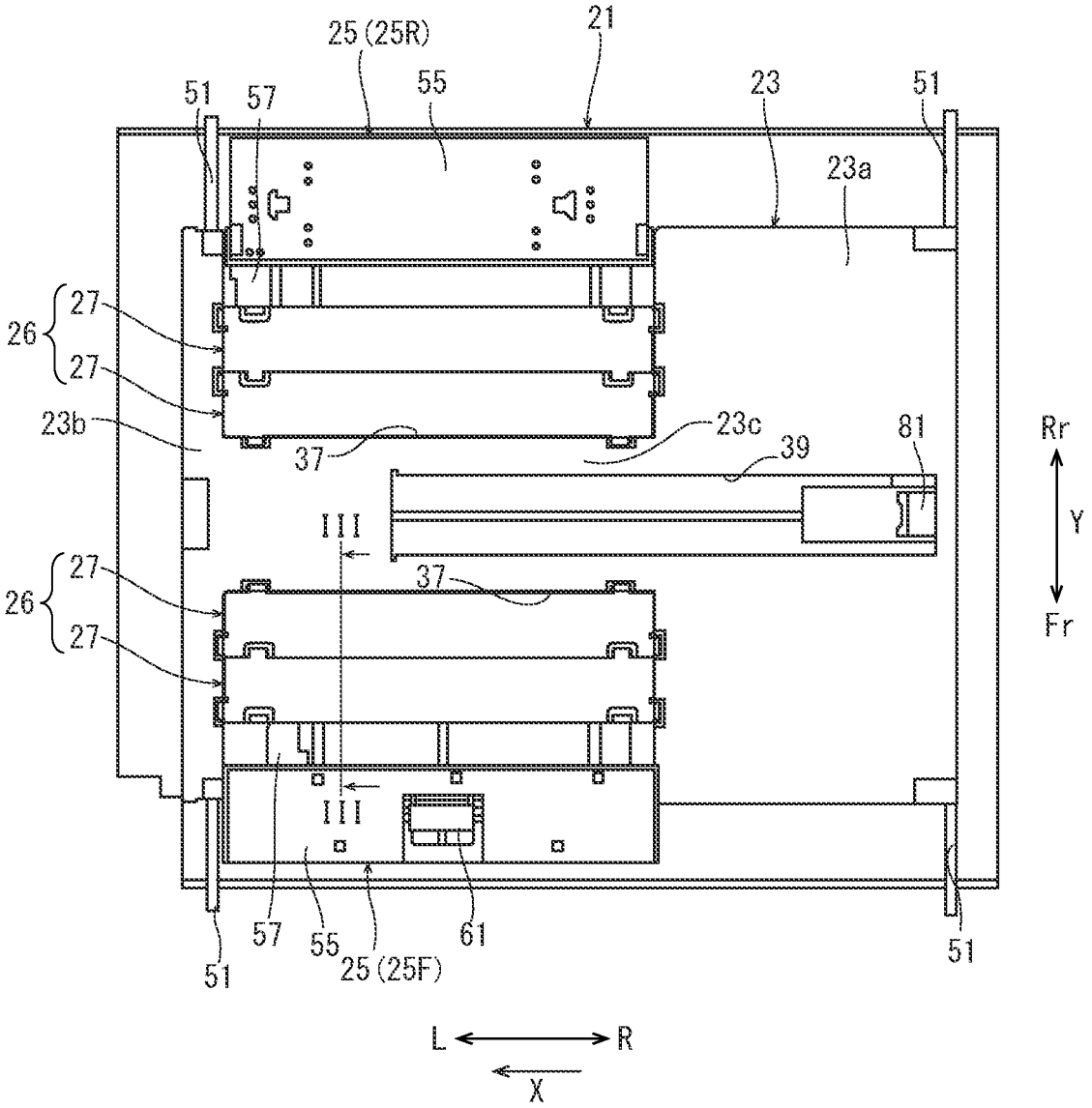
FIG. 4 is a plan view showing the large capacity deck (in a state where the auxiliary lift plates are attached) according to the embodiment of the present disclosure.
Figure 5:
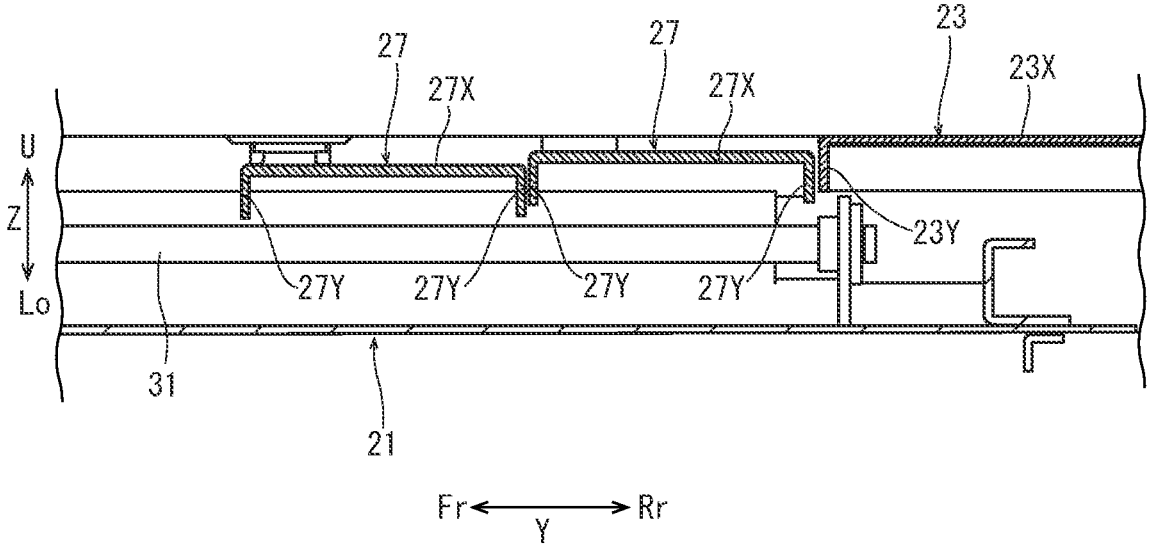
FIG. 5 is a sectional view taken along the line III-III in FIG. 4.
Figure 6:
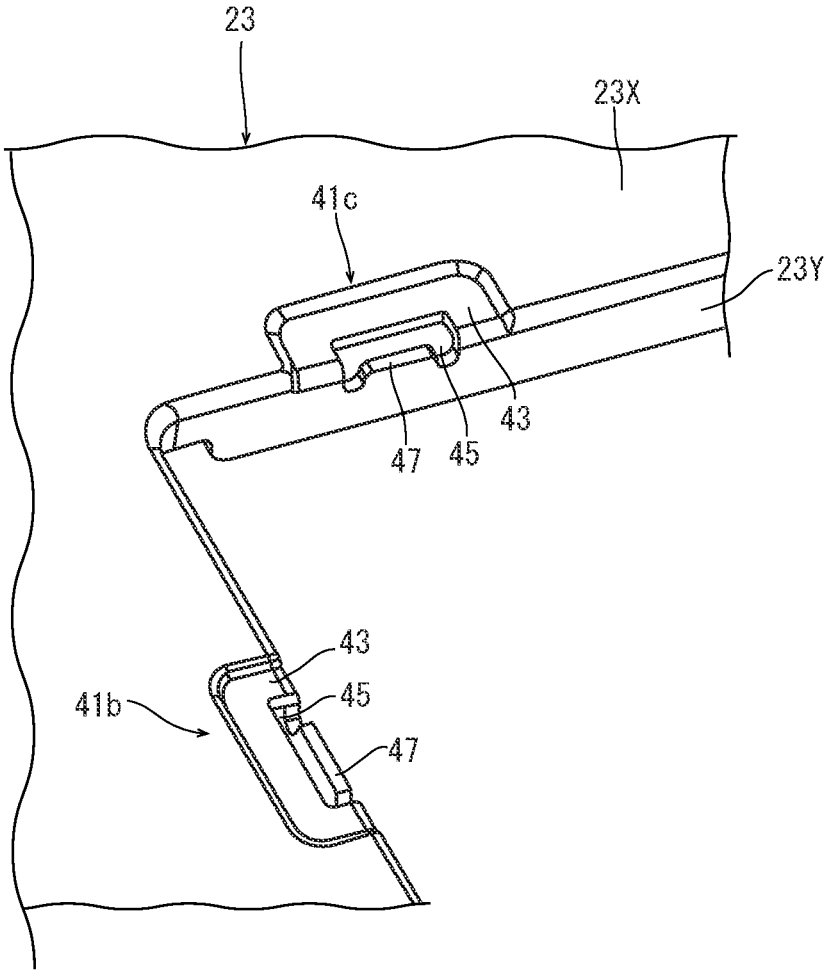
FIG. 6 is a perspective view showing an attachment recess of a lift plate, in the large capacity deck according to the embodiment of the present disclosure.

Next, with reference to FIG. 2 to FIG. 6, the large capacity deck 15 will be described. FIG. 2 is a perspective view showing a main body 21 of the large capacity deck 15, and FIG. 3 and FIG. 4 are plan views showing the main body 21 of the large capacity deck 15. FIG. 3 shows the main body 21 in a state where an auxiliary lift plate 26 is detached, and FIG. 4 shows the main body 21 in a state where auxiliary lift plates 26 are attached. FIG. 5 is a sectional view taken along the line III-III in FIG. 4. FIG. 6 is a perspective view showing an attachment recess 41 of a lift plate 23.

As shown in FIG. 2, FIG. 3 and FIG. 4, the large capacity deck 15 includes the main body 21 configured to accommodate the sheet, the lift plate 23 provided in the main body 21 and on which the sheets are placed, a pair of side cursors 25 (25F and 25R) provided in the main body 21 and which aligns the sheets placed on the lift plate 23, and the auxiliary lift plates 26 (see FIG. 4) attachable to and detachable from the lift plate 23. In the present embodiment, the sheet is fed along a sheet feeding direction X from the right side to the left side in FIG. 3 and FIG. 4. In the following description, the upstream and the downstream shows the upstream and the downstream in the sheet feeding direction X. Further, a direction (the front-and-rear direction) crossing to the sheet feeding direction X is referred to as a width direction Y, and the upper-and-lower direction (the vertical direction) is referred to as the upper-and-lower direction Z. The large capacity deck 15 is further provided with a coupling part (not shown) to which the image forming apparatus 1 is coupled and a sheet feeding device 12 which feeds the sheet placed on the lift plate 23 to the image forming apparatus 1.

The main body 21 has a size capable of placing a large number of (for example, 4000 sheets) the largest size sheets (for example, a A3 size sheet) on which an image is to be formed by the image forming part 7 of the image forming apparatus 1. In the upstream and downstream end portions of the side plates of the main body 21, slits 21*a* are formed along the upper-and-lower direction.

As shown in FIG. 3, guide rails 31 are supported on the downstream side portion of the bottom plate of the main body 21 along the width direction Y. The guide rails 31 are disposed on the upstream side and the downstream side on one side and the other side with respect to the center in the width direction Y. Further, on one side (the front side in this example) with respect to the center in the width direction Y, a stopper rod 33 is supported along the width direction Y between the upstream side and downstream side guide rails 31.

The lift plate 23 is a plate-like member having a size capable of placing the largest size sheet, and as shown in FIG. 5 and FIG. 6, is formed of a placement part 23X on which the sheets are placed, and a peripheral edge part 23Y bent downward from the peripheral edge of the placement part 23X at substantially right angles to the placement part 23X. The upper surface of the placement part 23X functions as a sheet placement surface.

As shown in FIG. 3 and FIG. 4, the lift plate 23 has an upstream side portion 23*a*, a downstream side portion 23*b*, and a central portion 23*c* between the upstream side portion 23*a* and the downstream side portion 23*b*. The upstream side portion 23*a* and the downstream side portion 23*b* have a rectangular planar shape long in the width direction Y and short in the sheet feeding direction X. The upstream side portion 23*a* and the downstream side portion 23*b* have the same width, and the length of the downstream side portion 23*b* is shorter than the length of the upstream side portion 23*a*. The central portion 23*c* is formed at the center of the width direction Y along the sheet feeding direction X. The central portion 23*c* has a width shorter than the upstream side portion 23*a* and the downstream side portion 23*b*, and is narrower than the width of the smallest size sheet (for example, a postcard).

In the above-described configuration, rectangular notch portions 37 are formed on both sides of the central portion 23*c* in the width direction Y. As shown in FIG. 3, through the notch portions 37, the guide rails 31 and the stopper rod 33 of the main body 21 are exposed. Further, the central portion 23*c* and the upstream side portion 23*a* has a rectangular opening 39 at the center in the width direction Y along the sheet feeding direction X.

As shown in FIG. 3, around the peripheral edge of each notch portion 37, a plurality of attachment recesses 41 (41*a*, 41*b* and 41*c*) are formed. In detail, the attachment recess 41 contains the two attachment recesses 41*a* and 41*b* formed around each end edge along the width direction Y, and the two attachment recesses 41*c* formed around the side edge along the sheet feeding direction X. The attachment recess 41*a* is disposed outside the attachment recess 41*b* in the width direction Y. The two attachment recesses 41*c* are disposed on the upstream end portion and the downstream end portion of the side edge.

As shown in FIG. 6, each attachment recess 41 has a rectangular recess 43 recessed from the placement part 23X (the sheet placement surface), a rectangular opening 45 formed in the recess 43 at the corner between the placement part 23X and the peripheral edge part 23Y, and a projection piece 47 projecting upward from the lower edge of the opening 45. The depth of the recess 43 is smaller than the plate thickness of the lift plate 23. The depth of the recess 43 of the attachment recess 41*a* disposed outside in the width direction Y is deeper than the recess 43 of the attachment recess 41*b* disposed inside in the width direction Y. The upper end surface of the projection piece 47 is flat and formed below the bottom surface of the recess 43.

As shown in FIG. 3 and FIG. 4, at the four corners of the lift plate 23, pins 51 protruding in the width direction Y are provided. As shown in FIG. 2, the pins 51 are protruded outside the main body 21 through the slits 21*a* formed in the side plates of the main body 21. To each pin 51, a wire 52 is connected. The wires 52 are connected to a winding roller 54 via pullies 53. When the winding roller 54 is rotated in one direction, the wires 52 are wound around the winding roller 54 to lift the lift plate 23 with the horizontal posture. The lift plate 23 is lifted until the uppermost sheet of the stacked sheets can be fed by the sheet feeding device (not shown). On the other hand, when the winding roller 54 is rotated in the counter direction, the wires 52 are fed from the winding roller 54 to lower the lift plate 23 with the horizontal posture. The lift plate 23 is lowered until it reaches the bottom plate of the main body 21.

Figure 7:
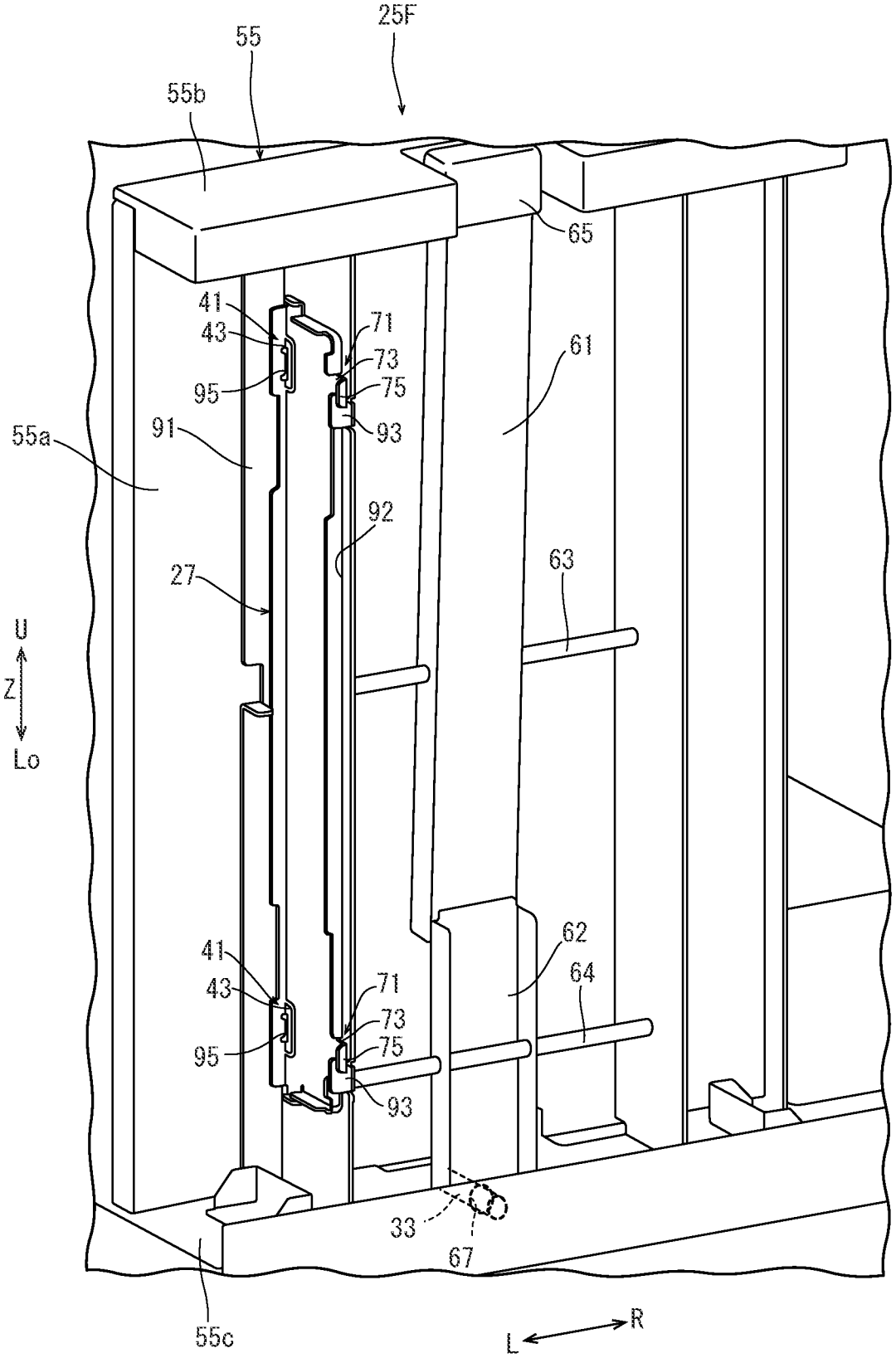
FIG. 7 is a perspective view showing a stopper mechanism of a side cursor and the auxiliary lift plate supported by the side cursor, in the large capacity deck according to the embodiment of the present disclosure.

Next, the pair of side cursors 25 (25F, 25R) will be described with reference to FIG. 7 in addition to FIG. 3 and FIG. 4. FIG. 7 is a perspective view showing a stopper mechanism or the like of the side cursor 25.

As shown in FIG. 3 and FIG. 4, the pair of side cursors 25 includes a front cursor 25F and a rear cursor 25R, and each of the front cursor 25F and the rear side cursor 25R has a side wall part 55 upright to the bottom plate of the main body 21 and an engagement part 57 along the bottom plate of the main body 21.

As shown in FIG. 7, the side wall part 55 has a vertical wall 55*a* having the predetermined length along the sheet feeding direction X and the predetermined height along the upper-and-rear direction Z, and an upper wall 55*b* and a lower wall 55*c* bent outward in the width direction Y from the upper edge and the lower edge of the vertical wall 55*a*. The length of the side wall part 55 along the sheet feeding direction X is slightly shorter than the length of the notch portion 37 of the lift plate 23 (see FIG. 3 and FIG. 4), and the height of the side wall part 55 along the upper-and-lower direction Z is higher than the height of the sheets of the maximum capacity.

The engagement part 57 extends in the width direction Y from the upstream side end portion of the lower edge of the side wall part 55 toward the center of the width direction Y. As shown in FIG. 3, a rack gear is formed along the downstream side edge of the engagement part 57 of the front cursor 25F, and a rack gear is formed along the upstream side edge of the engagement part 57 of the rear cursor 25R.

The front and rear cursors 25F and 25R are arranged in the notch portions 37 of the lift plate 23 so that the respective side wall parts 55 face each other in the width direction Y. Each engagement part 57 is slidably supported by the guide rails 31 of the main body 21. The rack gear of each engagement part 57 is engaged with a pinion gear (not shown) supported by the bottom plate of the main body 21. The stopper rod 33 of the main body 21 penetrates the lower end portion of the side wall part 55 of the front cursor 25F.

When the side wall part 55 of the front cursor 25F is moved in one direction, the engagement part 57 is slid along the guide rail 31 together with the side wall part 55 to rotate the pinion gear, and the engagement part 57 of the rear cursor 25R is moved in the other direction along the guide rail 31. Since each engagement part 57 is provided with a bearing (not shown), each engagement part 57 moves smoothly. As a result, both the side wall parts 55 slides synchronously in the direction of away from or close to each other. At this time, the side wall parts 55 pass through the notch portions 37 of the lift plate 23. The side wall parts 55 slide in the direction close to each other, and the vertical wall 55*a* comes into contact with the side edges of the sheets placed on the lift plate 23, whereby the sheets are aligned with respect to the center in the width direction Y. Thus, the inner surface of the vertical walls 55*a* function as a regulating surface for aligning the position of the sheets.

The pair of side cursors 25 is provided with a stopper mechanism which locks the side cursors 25 at the predetermined position. As shown in FIG. 7, the stopper mechanism includes an operation arm 61 and an engagement arm 62 which are long in the upper-and-lower direction and are operated together, and is disposed outside the vertical wall 55*a* of the side wall part 55 of the front cursor 25F. The operation arm 61 has a length longer than the engagement arm 62. The center portion of the operation arm 61 is supported by a turning shaft 63 provided along the sheet feeding direction X in a turnable manner. Thereby, the operation arm 61 is turned around the turning shaft 63. The upper end portion of the operation arm 61 is provided with a grip 65 which is operated by a user. The grip 65 is exposed through an opening formed in the upper wall 55*b* of the side wall part 55. The operation arm 61 is biased by a biasing member (not shown) such that the upper portion above the turning shaft 63 turns outward and the lower portion below the turning shaft 63 turns inward.

The engagement arm 62 is disposed below the operation arm 61. The center portion of the engagement arm 62 is supported by a turning shaft 64 provided along the sheet feeding direction X in a turnable manner. As a result, the engagement arm 62 is turned around the turning shaft 64. The upper end portion of the engagement arm 62 overlaps with the lower end portion of the operation arm 61 from the outside. An opening 67 along the width direction Y is formed at the lower end portion of the engagement arm 62. The stopper rod 33 penetrating through the side wall part 55 is inserted into the opening 67. The engagement arm 62 is biased by a biasing member (not shown) such that the upper portion above the turning shaft 64 turns inward and the lower portion below the turning shaft 64 turns outward. Thus, the peripheral edge of the opening 67 is engaged with the stopper rod 33, and the engagement arm 62 is immovable with respect to the stopper rod 33 by friction between them. That is, since the front cursor 25F is immovable, the sliding of the pair of side cursors 25 is restricted.

When the grip 65 of the operation arm 61 is pulled inward to turn the operation arm 61 around the turning shaft 63, the lower end portion of the operation arm 61 pushes the upper end portion of the engagement arm 62 outward to turn the engagement arm 62 around the turning shaft 64. Thus, the peripheral edge of the opening 67 separates from the stopper rod 33. That is, the engagement of the engagement arm 62 with the stopper rod 33 is released. As a result, the front cursor 25F is allowed to be moved so that the sliding of the pair of side cursors 25 is allowed. In the above manner, after the side cursors 25 are slid to the predetermined position while pulling the grip 65 of the operation arm 61 inward, when the grip 65 is released, the peripheral edge of the opening 67 of the engagement arm 62 is engaged with the stopper rod 33, and the side cursors 25 are immovable to lock the side cursors 25 at the predetermined position.

Figure 8A:
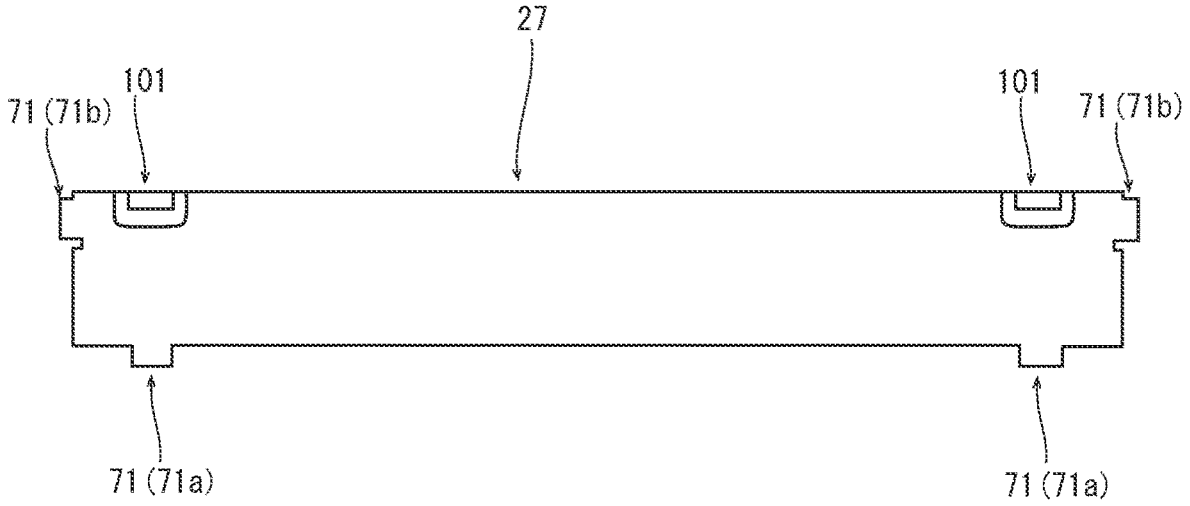
FIG. 8A is a plan view showing the auxiliary lift plate, in the large capacity deck according to the embodiment of the present disclosure.

Next, with reference to FIG. 4, FIG. 8A and FIG. 8B, the auxiliary lift plate 26 will be described. FIG. 8A is a plan view showing the auxiliary lift plate 26, and FIG. 8B is a perspective view showing a coupling recess 101 and a coupling hook 71 of the auxiliary lift plate 26.

As shown in FIG. 4, the auxiliary lift plate 26 includes two auxiliary lift pieces 27 attached to one notch portion 37 of the lift plate 23 and two auxiliary lift pieces 27 attached to the other notch portion 37 of the lift plate 23. The auxiliary lift pieces 27 have the same structure.

Figure 8B:
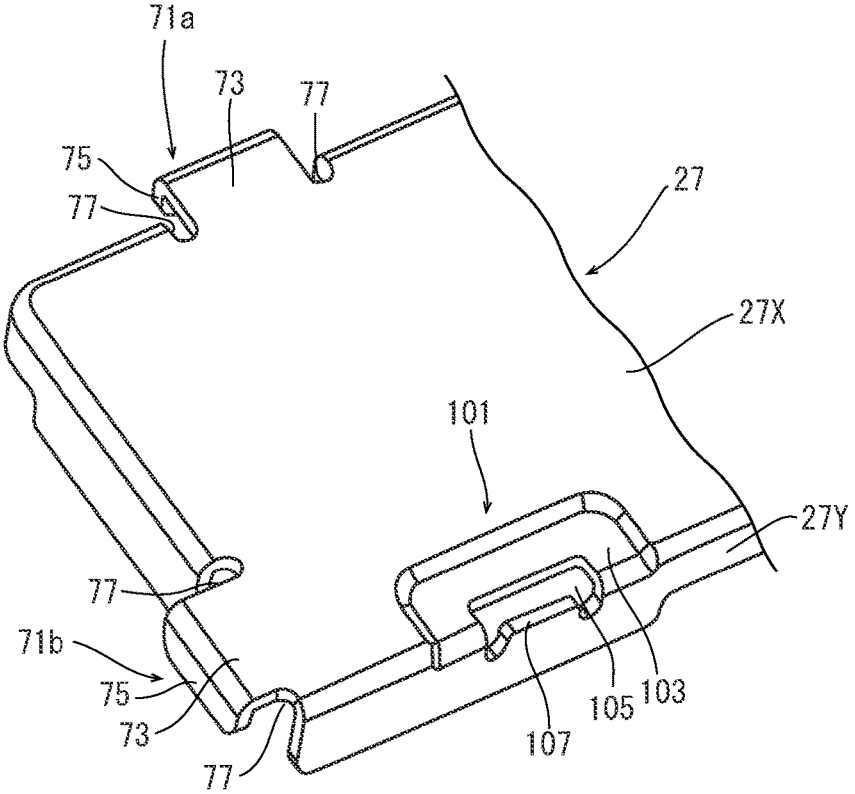
FIG. 8B is a perspective view showing a coupling recess and a coupling hook of the auxiliary lift plate, in the large capacity deck according to the embodiment of the present disclosure.

As shown in FIG. 8A and FIG. 8B, the auxiliary lift piece 27 is a rectangular plate-shaped piece having the same length as the length of the notch portion 37, a width shorter than the width of the notch portion 37 and the same thickness as the thickness of the lift plate 23. As shown in FIG. 8B, the auxiliary lift piece 27 is formed with a placement part 27X on which the sheets are placed, and a peripheral edge part 27Y bent downward from the peripheral edge of the placement part 23X at substantially right angles to the placement part 27X. The upper surface of the placement part 27X functions as a sheet placement surface.

Around the peripheral of the auxiliary lift piece 27, a plurality of coupling hooks 71 (71*a*, 71*b*) and a plurality of coupling recesses 101. As shown in FIG. 8A, the coupling hooks 71 contains the coupling hooks 71*a* formed around one side edge at the predetermined interval, and the coupling hook 71*b* formed around both end edges opposite to the one side edge. The coupling recess 101 is formed around the other side edge at the predetermined interval.

As shown in FIG. 8B, the coupling hook 71 has an extension portion 73 extending outward from the placement part 27X and a bent portion 75 bent downward from the tip end of the extension portion 73 at substantially right angles. On both sides of the extension portion 73, notches 77 are formed.

The coupling recess 101 has the same structure as the attachment recess 41 (see FIG. 6) of the lift plate 23, and has a rectangular recess 103 recessed from the placement part 27 (the sheet placement surface), a rectangular opening 105 formed in the recess 103 at the corner between the placement part 27X and the peripheral edge part 27Y, and a projection piece 107 projecting upward from the lower edge of the opening 105. The upper end surface of the projection piece 107 is flat and formed below the bottom surface of the recess 103.

Referring again to FIG. 3 and FIG. 4, the main body 21 is provided with an end cursor 81. The end cursor 81 is disposed at the center of the bottom plate of the main body 21 in the width direction Y. The end cursor 81 is supported by the main body 21 in a slidable manner along the sheet feeding direction X through the opening 39 of the lift plate 23.

Figure 9:
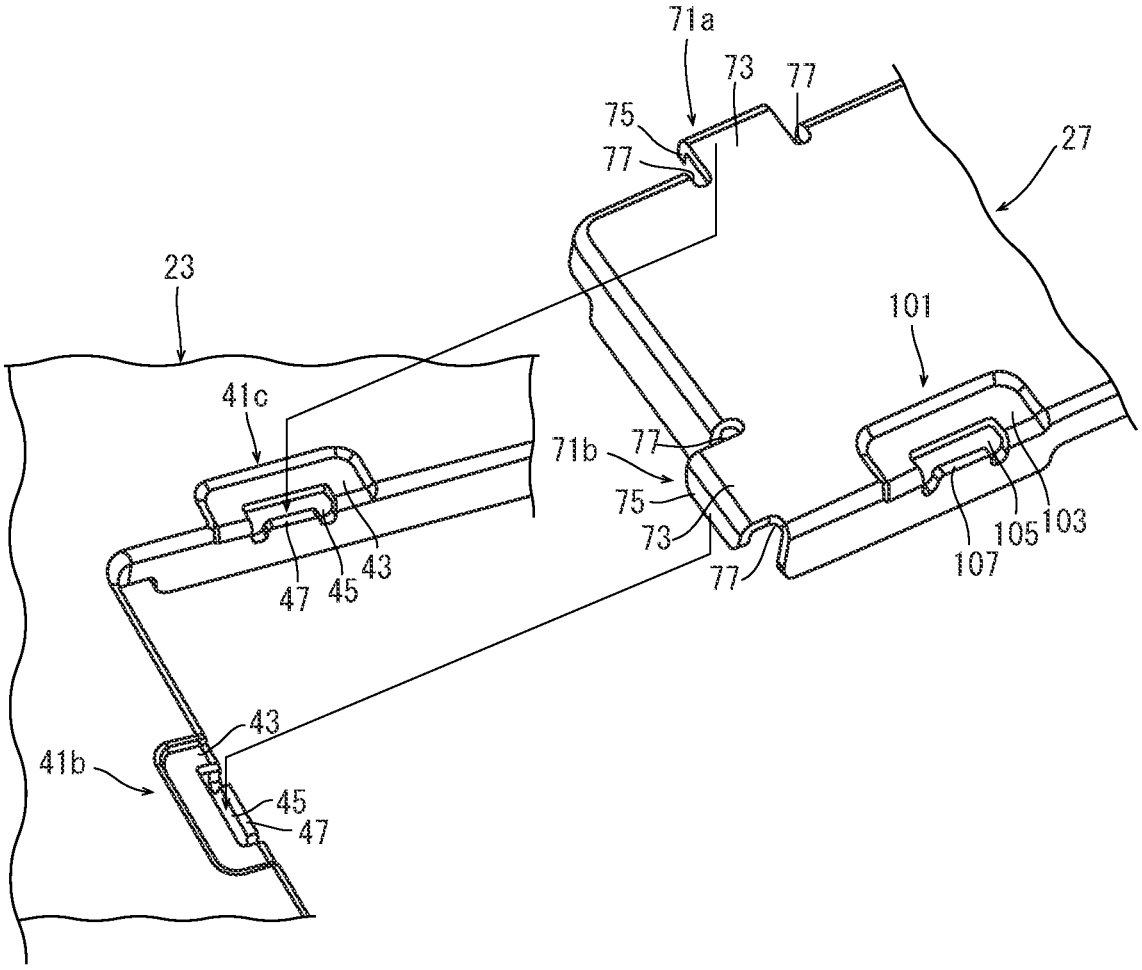
FIG. 9 is a perspective view showing the auxiliary lift plate and the lift plate in the large capacity deck according to the embodiment of the present disclosure, in a middle of a procedure for attaching the auxiliary lift plate to the lift plate.

A procedure for placing the sheets to the large capacity deck 15 having the above configuration will be described with reference to FIG. 3 to FIG. 5 and FIG. 9. FIG. 9 is a perspective view showing the lift plate 23 and the auxiliary lift plate 26 in a middle of the procedure for placing the sheets to the large capacity deck 15. In an initial state (a state where the sheets are not placed), the side cursors 25 are slid to the outermost (see FIG. 3).

In a case where the smallest size sheets (for example, a postcard) are placed on the lift plate 23, as shown in FIG. 3, the auxiliary lift plate 26 is not attached to the lift plate 23. The sheets are mainly placed on the downstream side portion 23*b* and the central portion 23*c* of the lift plate 23. After the sheet is placed, the stopper mechanism of the pair of side cursors 25 is released (see FIG. 7, the grip 65 of the operation arm 61 is pulled inward), one side cursor 25 is moved such that the vertical walls 55*a* (see FIG. 7) of the side wall parts 55 of the side cursors 25 are brought into contact with the side edges of the sheets. As a result, the sheets are aligned at the center in the width direction Y. Further, the end cursor 81 is moved to come into contact with the end edges of the sheets. Thereafter, the lift plate 23 is lifted until the uppermost sheet of the stacked sheets reaches the sheet feeding position.

In a case where the largest size sheets (for example, an A3 size sheet) are placed on the lift plate 23, the sheets are placed on the upstream side portion 23*a*, the central portion 23*c* and the downstream side portion 23*b* of the lift plate 23, and the downstream portions of the sheets overlap with the notch portions 37. If the placed sheets overlap with the notch portions 37, the sheets may be deformed as described above. Especially, if the number of the sheets is large, the possibility that the sheets are deformed becomes high. Then, in this case, the auxiliary lift plate 26 is attached to the lift plate 23. In the embodiment, a case where two auxiliary lift pieces 27 are attached to each notch portion 37 will be described.

First, the coupling hooks 71 of the first auxiliary lift piece 27 are coupled to the attachment recesses 41 of the lift plate 23. In detail, two coupling hooks 71*a* formed around the side edge of the first auxiliary lift piece 27 are engaged with two attachment recesses 41*c* formed around the side edge of the notch portion 37 of the lift plate 23, and the coupling hooks 71*b* formed around the end edges of the first auxiliary lift piece 27 are engaged with the inner attachment recesses 41*b* formed around the end edges of the notch portion 37 of the lift plate 23. At this time, as shown in FIG. 9, the bent portion 75 of the coupling hook 71 is inserted into the opening 45 of the attachment recess 41. Then, the extension portion 73 of the coupling hook 71 is placed on the upper end surface of the projection piece 47 of the attachment recess 41. Because the upper end surface of the projection piece 47 is below the bottom surface of the recess 43, as shown in FIG. 5, the sheet placement surface of the placement part 27X of the first auxiliary lift piece 27 is lower than the sheet placement surface of the placement part 23X of the lift plate 23.

Next, the coupling hooks 71 of the second auxiliary lift piece 27 are coupled to the attachment recesses 41 of the lift plate 23 and the coupling recesses 101 of the first auxiliary lift piece 27. In detail, two coupling hooks 71*a* formed around the side edge of the second auxiliary lift piece 27 are engaged with two coupling recesses 101 formed around the side edge of the first auxiliary lift piece 27, and the coupling hooks 71*b* formed around the end edges of the second auxiliary lift piece 27 are engaged with the outer attachment recesses 41*a* formed around the end edges of the notch portion 37 of the lift plate 23. As a result, the lift auxiliary pieces 27 are connected to each other, and are arranged side by side in the width direction. As described above, the sheet placement surface of the placement part 27X of the first auxiliary lift piece 27 is lower than the sheet placement surface of the placement part 23X of the lift plate 23. Further, the depth of the recess 43 of the outer attachment recess 41*a* is deeper than the depth of the recess 43 of the inner attachment recess 41*a*. Then, as shown in FIG. 5, the sheet placement surface of the placement part 27X of the second auxiliary lift piece 27 is lower than the sheet placement surface of the placement part 27X of the first auxiliary lift piece 27.

After the two lift auxiliary pieces 27 are attached to each notch portion 37, the sheets are placed on the lift plate 23. Since the downstream portions of the sheets are supported by the lift plate 23 and the auxiliary lift plate 26, the sheets can be placed without being deformed. After the sheets are placed, the stopper mechanism of the pair of side cursors 25 is released in the above-described manner, and one of the side cursors 25 is moved so that the vertical walls 55*a* of the side walls 55 of the pair of side cursors 25 are brought into contact with the side edges of the sheets. Thus, the sheets are aligned at the center in the width direction Y. Further, the end cursor 81 is moved to come into contact with the end edges of the sheets. Thereafter, the lift plate 23 is lifted until the uppermost sheet of the placed sheets reaches the sheet feeding position.

As described above, according to the present disclosure, by attaching the auxiliary lift plates 26 to the notch portions 37 of the lift plate 23, the large size sheets can be lifted and lowered without being deformed. Therefore, it becomes possible to feed the sheet stably. Additionally, the auxiliary lift plate 26 can be attached to and detached from the lift plate 23 by a simple work such as engagement of the coupling hook 71 with the attachment recess 41 or the coupling recess 101.

Since the height of the sheet placement surface of the auxiliary lift plate 26 is lower than the height of the sheet placement surface of the lift plate 23, the side edges of the sheets can be prevented from being caught in a gap between the lift plate 23 and the auxiliary lift plate 26 or a gap between the auxiliary lift pieces 27.

Further, since the auxiliary lift pieces 27 have the same shape, the number of auxiliary lift pieces 27 to be attached to the notch portion 37 can be changed according to the size of the sheet. For example, in the case of a sheet of a relatively small size, one auxiliary lift piece 27 may be attached to each notch portion 37. Further, the number of the auxiliary lift pieces 27 attachable to the notch portion 37 is not limited to two, but may be three or more. Further, the plurality of auxiliary lift pieces 27 may be different in width. In this case, the attachment recesses 41 of the lift plate 23 are arranged to correspond to the coupling hooks 71 of the auxiliary lift piece 27.

Next, a modified example of the present disclosure will be described with reference to FIG. 7. In this modified example, one side cursor 25F is provided with a support plate 91 capable of supporting the auxiliary lift piece 27.

The support plate 91 is provided on the outside surface of the vertical wall 55*a* of the side wall part 55 of one side cursor 25F between the upper and lower walls 55*b* and 55*c* along the upper-and-lower direction Z. In the support plate 91, an opening 92 having a dimension capable of accommodating the auxiliary lift piece 27 is formed along the upper-and-lower direction Z. On one longitudinal edge of the opening 92, two hook pieces 93 are formed at the predetermined interval. On the other longitudinal edge of the opening 92, two protrusions 95 are formed at the predetermined interval. The support plate 91 is an example of an accommodation portion of the auxiliary lift plate 26 in the present disclosure.

The extension portion 73 and the bent portion 75 of each coupling hook 71 of the auxiliary lift piece 27 are engaged with the hook pieces 93, and the protrusions 95 of the support plate 91 are engaged with the openings 105 of the coupling recesses 101 of the auxiliary lift piece 27 so that the auxiliary lift piece 27 is accommodated by the support plate 91. A plurality of the support plates 91 may be formed on the side cursor 25.

Thus, since it is not necessary to newly provide a storage place for the auxiliary lift piece 27, the management of the auxiliary lift plate 26 is facilitated.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. A sheet feeding cassette comprising:

a main body configured to accommodate a sheet fed out in a predetermined sheet feeding direction;

a lift plate provided in the main body in a liftable manner, and having a sheet placement surface on which the sheet is placed;

a pair of side cursors configured to be moved in a width direction perpendicular to the sheet feeding direction and to come into contact with side edges of the sheet placed on the lift plate to align the sheet; and an auxiliary lift plate which is detachably attached to a notch portion which is formed in the lift plate so as to allow a moving of the side cursors, and an upper surface of the auxiliary lift plate is disposed lower than the sheet placement surface of the lift plate.

2. The sheet feeding cassette according to claim 1, wherein the auxiliary lift plate is constituted of a plurality of auxiliary lift pieces connectable to each other in the width direction, and a width of the auxiliary lift plate can be changed by changing a number of the auxiliary lift pieces.

3. The sheet feeding cassette according to claim 2, wherein the plurality of auxiliary lift pieces are arranged side by side along the width direction, and upper surfaces of the plurality of auxiliary lift pieces are set to be lower as the auxiliary lift pieces are arranged outside in the width direction.

4. The sheet feeding cassette according to claim 1, wherein at least one of the pair of side cursors has an accommodation portion capable of accommodating the auxiliary lift piece detached from the lift plate.

5. The sheet feeding cassette according to claim 4, wherein the accommodation portion includes a support plate provided on an outside surface of a side wall part of at least one of the side cursors along an upper-and-lower direction, and at least one of the auxiliary lift pieces is detachably attached to the support plate.

6. An image forming apparatus comprising:

the sheet feeding cassette according to claim 1;

an apparatus main body to which the sheet feeding cassette is detachably attached;

a sheet feeding device which feeds the sheet from the sheet feeding cassette attached to the apparatus main body; and an image forming part which forms an image on the sheet fed from the sheet feeding cassette by the sheet feeding device.

7. The image forming apparatus according to claim 6, wherein the sheet feeding cassette is a large capacity deck which can accommodate a large number of the sheets, and the lift plate is lifted and lowered with a horizontal posture.

* * * * *